US006404138B1

(12) United States Patent
Okamoto et al.

(10) Patent No.: US 6,404,138 B1
(45) Date of Patent: Jun. 11, 2002

(54) COLD CATHODE DISPLAY DEVICE AND DRIVING METHOD

(75) Inventors: Akihiko Okamoto; Kazuo Konuma, both of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/568,250

(22) Filed: May 10, 2000

(30) Foreign Application Priority Data

May 12, 1999 (JP) ..... 11-131997

(51) Int. Cl.[7] ..... G09G 3/10

(52) U.S. Cl. ..... 315/169.3; 313/306; 313/309; 313/351

(58) Field of Search ..... 315/169.3, 169.1; 313/441, 495, 351, 309, 306, 307, 336, 496, 497

(56) References Cited

U.S. PATENT DOCUMENTS 5,814,931 A * 9/1998 Makishima ..... 313/441
5,965,977 A * 10/1999 Makishima ..... 313/495

FOREIGN PATENT DOCUMENTS

JP 9-115426 5/1997
JP 2737616 1/1998

* cited by examiner

*Primary Examiner*—Don Wong
*Assistant Examiner*—Thuy Vinh Tran
(74) *Attorney, Agent, or Firm*—Young & Thompson

(57) ABSTRACT

A method of driving a cold cathode element, includes (a) providing a plurality of cold cathodes; (b) deflecting a plurality of electron beams respectively emitted from the plurality of cold cathodes; (c) providing at least one control electrode for at least one of the plurality of cold cathodes, wherein an electric field above the control electrode is changed when a voltage is applied to the control electrode; and (d) controlling the voltage applied to the control electrode such that the plurality of electron beams are concentrated on a fluorescent surface.

35 Claims, 7 Drawing Sheets

COLD CATHODE DISPLAY DEVICE AND DRIVING METHOD

BACKGROUND OF THE INVENTION

1. Field of the Invention

The present invention relates to a method of driving an electric field emission type cold cathode element having at least one electric field emission type cold cathode. Further, the present invention relates to a display apparatus for using the electric field emission type cold cathode element as an electron-generating source.

2. Description of the Related Art

In an electric field emission type cold cathode element, a gate electrode is arranged adjacently to a flat type emitter or a cone-shaped sharp emitter, and a high electric field is concentrated on the emitter through the gate electrode to emit electrons from the emitter.

In this electric field emission type cold cathode element, a current density can be made higher than that of a hot (thermionic) cathode element. The electric field emission type cold cathode element can be applied to a display apparatus needing a high current density, for example, such as a Braun tube and the like. There is a merit that a constant voltage driving and a heater are unnecessary, if the cold cathode element is used as a source of electrons, such as the Braun tube and the like, instead of the hot cathode.

In the display apparatus, the electrons emitted from the emitter are passed in vacuum through an electron lens (including a main lens) mounted above the emitter, and are sent to a (display) screen as an electron beam while deflected by a magnet field provided by a deflection yoke, between the electron lens and the screen. Especially, a color display apparatus usually uses three cold cathodes corresponding to the three primary colors of a red (R), a green (G) and a blue (B). It is required to superimpose three electron beams from the three cold cathodes of R, G and B on the screen to further make a diameter of a beam spot thinner (smaller).

In a usual case, such a color display apparatus employs an in-line structure, namely, a structure in which the three cold cathodes (electron guns) corresponding to the three primary colors are aligned in one lateral row. In such structure, beams emitted from the three electron guns arrive at the screen in the magnetic field. However, the beams are not usually concentrated into one point on the screen under an uniform magnet field. So, in order to concentrate the three electron beams so that they are superimposed on the screen, a magnetic field for the concentration is applied from external portion. That is to say, the beam passed through an outer side is passed through the high-strength magnetic field to be deflected largely. The beam passed through an inner side is passed through the low-strength magnetic field to be deflected small. As a result, the three beams are concentrated into one point on the screen.

A technique of self-convergence has been used for attaining such concentration of the beams on the screen without adjustment. This technique contrives the deflection yoke so that a horizontal deflection magnetic distribution is pincushion-shaped and a vertical deflection magnetic distribution is barrel-shaped to generate a magnetic field combined by the distorted deflection magnetic fields. However, when the electron beams are passed through such magnetic field, the respective beams are distorted by the strongly distorted deflection magnetic field. This distortion causes the generation of aberration referred to as astigmatism or spot coma, which further causes a beam diameter to be larger, and also causes a spot form to be distorted. The following method is proposed with regard to a control to avoid such beam form from being distorted.

That is, for example, Japanese Laid Open Patent Application (JP-A-Heisei, 7-147129) (Patent Publication No.2737616) discloses a technique that divides an emitter array constituting an electric field emission type cold cathode into a plurality of areas, and when a beam spot is located at a center of a display screen which is not distorted, drives only a circular emitter array area, and when the spot is located around a circumference of the display screen, drives the circular emitter array area and a sub emitter array area around it at the same time, and then sets them at a longitudinally long form, and accordingly suppresses the generation of the distortion in the beam spot. However, in this technique, the sizes of the spots of electron beams are different between the center and the circumference of the display screen. This results in a problem that a uniform resolution can not be obtained.

Also, for example, Japanese Laid Open Patent Application (JP-A-Heisei, 9-115426) discloses a technique that mounts a plurality of convergence electrodes around a gate electrode, and corrects a spot form laterally crashed because of distortion of a magnetic field, when electrons are passed through a self-convergence deflection magnetic field. However, this technique generates the magnetic field combined by deflection magnetic fields distorted by making a horizontal deflection magnetic distortion in a pincushion-shaped state and making a vertical deflection magnetic distortion in a barrel-shaped state. Thus, this technique requires a complex deflection yoke. Also, the yoke must be designed for each type of display apparatus. Also, a development method based on an adjustment in an actual sample is used, which leads to the increase of a development period and a development cost. Moreover, the variations between the individual display apparatuses and the mounting ways cause a difference between samples, which easily brings about defective samples having larger beam diameters, and results in a drop of yield.

SUMMARY OF THE INVENTION

The present invention is accomplished in view of the above mentioned problems. Therefore, an object of the present invention is to provide a method of driving an electric field emission type cold cathode element that can disuse the horizontal deflection magnetic distribution and the vertical deflection magnetic distribution or can make them smaller, and can suppress the distortion in the beam form caused by the magnetic distribution and the larger (thicker) diameter of the beam spot on the screen, and a display apparatus using this method.

In order to achieve an aspect of the present invention, a method of driving a cold cathode element, includes: (a) providing a plurality of cold cathodes; (b) deflecting a plurality of electron beams respectively emitted from the plurality of cold cathodes; (c) providing at least one control electrode for at least one of the plurality of cold cathodes, wherein an electric field above the control electrode is change d when a voltage is applied to the control electrode; and (d) controlling the voltage applied to the control electrode such that the plurality of electron beams are concentrated on a fluorescent surface.

In this case, the (d) step includes controlling the voltage to be a value close to a voltage applied to one of gate electrodes of the plurality of cold cathodes.

In order to achieve another aspect of the present invention, a method of driving a cold cathode element, includes: (e) providing a plurality of cold cathodes including a first cold cathode and a second cold cathode; (f) deflecting in a deflecting direction a plurality of electron beams respectively emitted from the plurality of cold cathodes; (g) providing at least one control electrode for at least one of the plurality of cold cathodes; and (h) controlling a voltage applied to the control electrode such that a first potential of the first cold cathode is different from a second potential of the second cold cathode, wherein the first potential is a potential difference between a first deflecting side in the deflecting direction and a first opposite side opposite to the first deflecting side above the first cold cathode, and the second potential is a potential difference between a second deflecting side in the deflecting direction and a second opposite side opposite to the second deflecting side above the second cold cathode.

In this case, the (g) step includes providing the control electrode such that an electric field above the control electrode is changed when a voltage is applied to the control electrode.

Also in this case, the (e) step includes providing the plurality of cold cathode such that the first cold cathode is provided nearer in the deflecting direction than the second cold cathode, and wherein the (h) step includes controlling the voltage such that the first potential is lower than the second potential.

Further in this case, the (g) step includes providing a couple of the control electrodes on a deflecting side in the deflecting direction and an opposite side opposite to the deflecting side of each of the plurality of cold cathodes.

In this case, the (g) step includes providing the couple of control electrodes such that the voltage applied to one of the couple of control electrodes is controlled independently of the voltage applied to the other of the couple of control electrodes.

Also in this case, the (g) step includes providing a plurality of the control electrodes around each of the plurality of cold cathodes.

Further in this case, the (g) step includes providing a plurality of the control electrode respectively corresponding to the first deflecting and opposite sides and the second deflecting and opposite sides.

In this case, the (e) step includes providing the plurality of cold cathode such that the first cold cathode is provided nearer in the deflecting direction than the second cold cathode, and wherein the (e) step includes providing the plurality of cold cathodes such that each of the plurality of cold cathodes includes a gate electrode, a plurality of voltages applied to a plurality of the gate electrode corresponding to the plurality of cold cathodes being a same with respect to each other, and wherein the (h) step includes controlling a first deflecting voltage applied to the control electrode corresponding to the first deflecting side to be lower than a first gate voltage applied to the gate electrode of the first cold cathode and controlling a first opposite voltage applied to the control electrode corresponding to the first opposite side to be higher than the first gate voltage and controlling a second deflecting voltage applied to the control electrode corresponding to the second deflecting side to be higher than a second gate voltage applied to the gate electrode of the second cold cathode, and controlling a second opposite voltage applied to the control electrode corresponding to the second opposite side to be lower than the second gate voltage.

In order to achieve still another aspect of the present invention, a method of driving a cold cathode element, includes: (aa) providing three cold cathodes in an in-line arrangement, wherein the three cold cathodes correspond to three primary colors of a red (R), a green (G) and a blue (B), respectively and each of the three cold cathodes includes a gate electrode; (ab) applying a first gate voltage to the gate electrode of the cold cathode, as a R cold cathode, corresponding to the R; (ac) applying a second gate voltage to the gate electrode of the cold cathode, as a G cold cathode, corresponding to the G; (ad) applying a third gate voltage to the gate electrode of the cold cathode, as a B cold cathode, corresponding to the B; (ae) deflecting three electron beams respectively emitted from the three cold cathodes in a deflecting direction along the arrangement proceeding from the B cold cathode to the R cold cathode; (af) providing a first deflecting control electrode in the deflecting direction of the R cold cathode and a first opposite control electrode in a direction opposite to the deflecting direction of the R cold cathode; (ag) providing a second deflecting control electrode in the deflecting direction of the G cold cathode and a second opposite control electrode in the opposite direction of the G cold cathode; (ah) providing a third deflecting control electrode in the deflecting direction of the B cold cathode and a third opposite control electrode in the opposite direction of the B cold cathode; and (ai) controlling a first deflecting voltage applied to the first deflecting control electrode to be lower than the first gate voltage and controlling a first opposite voltage applied to the first opposite control electrode to be higher than the first gate voltage and controlling a second voltage applied to each of the second deflecting and opposite control electrodes equal to the second gate voltage and controlling a third deflecting voltage applied to the third deflecting control electrode to be higher than the third gate voltage, and controlling a third opposite voltage applied to the third opposite control electrode to be lower than the third gate voltage, and wherein when a voltage is applied to each of the first deflecting and opposite control electrodes and the second deflecting and opposite control electrodes, and the third deflecting and opposite control electrodes, an electric field above the each voltage-applied control electrode is changed, respectively.

In order to achieve yet still another aspect of the present invention, a method of driving a cold cathode element, includes: (ba) providing a cold cathode; (bb) deflecting a electron beam emitted from the cold cathode; (bc) providing a control electrode for the cold cathode, wherein an electric field above the control electrode is changed when a voltage is applied to the control electrode; and (bd) controlling the voltage applied to the control electrode such that the electron beam is concentrated on a fluorescent surface.

In this case, the (bd) step includes controlling the voltage such that if a distance between the cold cathode and a position at which the electron beam is radiated on the fluorescent surface is changed to be longer as the result of the (bb) step, the longer the distance, the lower a potential above the cold cathode becomes.

Also in this case, wherein the (bd) step includes controlling the voltage such that if a distance between the cold cathode and a position at which the electron beam is radiated on the fluorescent surface is changed to be longer as the result of the (bb) step, an expansion of the electron beam is suppressed.

Further in this case, wherein the (bd) step includes controlling the voltage such that if a distance between the cold cathode and a position at which the electron beam is radiated on the fluorescent surface is changed to be longer as the result of the (bb) step, a focus point of the electron beam is positioned at a further point.

In this case, the (bd) step includes controlling the voltage to be a lower value when a distance between the cold cathode and a position at which the electron beam is radiated on the fluorescent surface is changed to be longer as the result of the (bb) step.

Also in this case, the (bd) step includes controlling the voltage to be a value close to a voltage applied to a gate electrode of the cold cathode.

Further in this case, the (bc) step includes providing the control electrode which is circular around the cold cathode.

In order to achieve another aspect of the present invention, a method of driving a cold cathode element, includes: (ca) providing a plurality of cold cathodes including a first cold cathode and a second cold cathode; (cb) deflecting in a deflecting direction a plurality of electron beams respectively emitted from the plurality of cold cathodes; (cc) providing first and second control electrodes for at least one of the plurality of cold cathodes; (cd) controlling a first voltage applied to the first control electrode such that a first potential of the first cold cathode is different from a second potential of the second cold cathode, wherein the first potential is a potential difference between a first deflecting side in the deflecting direction and a first opposite side opposite to the first deflecting side above the first cold cathode, and the second potential is a potential difference between a second deflecting side in the deflecting direction and a second opposite side opposite to the second deflecting side above the second cold cathode; and (ce) controlling a second voltage applied to the second control electrode such that if a distance between one of the plurality of cold cathodes and positions at which the plurality of electron beams are radiated on the fluorescent surface is changed to be longer as the result of the (cb) step, the longer the distance, the lower the second voltage becomes.

In order to achieve still another aspect of the present invention, a display apparatus, includes: a plurality of cold cathodes from which a plurality of electron beams are emitted respectively; a fluorescent surface on which the plurality of electron beams are radiated; a control electrode for at least one of the plurality of cold cathodes, wherein an electric field above the control electrode is changed when a voltage is applied to the control electrode; and a control unit controlling the voltage applied to the control electrode such that when the plurality of electron beams are deflected, the plurality of electron beams are concentrated on the fluorescent surface.

In this case, the control unit controls the voltage to be a value close to a voltage applied to one of gate electrodes of the plurality of cold cathodes.

In order to achieve yet still another aspect of the present invention, a display apparatus, includes: a plurality of cold cathodes from which a plurality of electron beams are emitted respectively, wherein the plurality of cold cathodes include a first cold cathode and a second cold cathode; a deflecting unit deflecting in a deflecting direction the plurality of electron beams; a control electrode section for at least one of the plurality of cold cathodes; and a control unit controlling a voltage applied to the control electrode section such that a first potential of the first cold cathode is different from a second potential of the second cold cathode, wherein the first potential is a potential difference between a first deflecting side in the deflecting direction and a first opposite side opposite to the first deflecting side above the first cold cathode, and the second potential is a potential difference between a second deflecting side in the deflecting direction and a second opposite side opposite to the second deflecting side above the second cold cathode.

In this case, an electric field above the control electrode section is changed when a voltage is applied to the control electrode section.

Also in this case, the first cold cathode is provided nearer in the deflecting direction than the second cold cathode, and wherein the control unit controls the voltage such that the first potential is lower than the second potential.

Further in this case, the control electrode section includes a plurality of control electrodes respectively provided on a deflecting side in the deflecting direction and an opposite side opposite to the deflecting side of each of the plurality of cold cathodes.

In this case, a voltage applied to one of a couple of control electrodes corresponding to each of the plurality of cold cathodes of the plurality of control electrodes is controlled by the control unit, independently of a voltage applied to the other of the couple of control electrodes.

Also in this case, a plurality of control electrodes are provided, as the control electrode section, around each of the plurality of cold cathodes.

Further in this case, the plurality of control electrodes are provided respectively corresponding to the first deflecting and opposite sides and the second deflecting and opposite sides.

In this case, the first cold cathode is provided nearer in the deflecting direction than the second cold cathode, and wherein each of the plurality of cold cathodes includes a gate electrode, a plurality of voltages applied to a plurality of the gate electrode corresponding to the plurality of cold cathodes being a same with respect to each other, and wherein the control unit controls a first deflecting voltage applied to the control electrode corresponding to the first deflecting side to be lower than a first gate voltage applied to the gate electrode of the first cold cathode and controls a first opposite voltage applied to the control electrode corresponding to the first opposite side to be higher than the first gate voltage and controls a second deflecting voltage applied to the control electrode corresponding to the second deflecting side to be higher than a second gate voltage applied to the gate electrode of the second cold cathode, and controls a second opposite voltage applied to the control electrode corresponding to the second opposite side to be lower than the second gate voltage.

In order to achieve another aspect of the present invention, a display apparatus, includes: three cold cathodes in an in-line arrangement, wherein the three cold cathodes correspond to three primary colors of a red (R), a green (G) and a blue (B), respectively and each of the three cold cathodes includes a gate electrode; a gate voltage applying unit applying a first gate voltage to the gate electrode of the cold cathode, as a R cold cathode, corresponding to the R, and applying a second gate voltage to the gate electrode of the cold cathode, as a G cold cathode, corresponding to the G;, and applying a third gate voltage to the gate electrode of the cold cathode, as a B cold cathode, corresponding to the B; a deflecting unit deflecting three electron beams respectively emitted from the three cold cathodes in a deflecting direction along the arrangement proceeding from the B cold cathode to the R cold cathode; a first deflecting control electrode in the deflecting direction of the R cold cathode; a first opposite control electrode in a direction opposite to the deflecting direction of the R cold cathode; a second deflecting control electrode in the deflecting direction of the G cold cathode; a second opposite control electrode in the opposite direction of the G cold cathode; a third deflecting control electrode in the deflecting direction of the B cold cathode; a third opposite control electrode in the opposite direction of the B cold cathode; and a control unit controlling a first deflecting voltage applied to the first deflecting control electrode to be lower than the first gate voltage and controlling a first opposite voltage applied to the first opposite control electrode to be higher than the first gate voltage and controlling a second voltage applied to each of the second deflecting and opposite control electrodes equal to the second gate voltage and controlling a third deflecting voltage applied to the third deflecting control electrode to be higher than the third gate voltage, and controlling a third opposite voltage applied to the third opposite control electrode to be lower than the third gate voltage, and wherein when a voltage is applied to each of the first deflecting and opposite control electrodes and the second deflecting and opposite control electrodes, and the third deflecting and opposite control electrodes, an electric field above the each voltage-applied control electrode is changed, respectively.

In order to achieve still another aspect of the present invention, a display apparatus, includes: a cold cathode; a fluorescent surface; a deflecting unit deflecting a electron beam emitted from the cold cathode; a control electrode for the cold cathode, wherein an electric field above the control electrode is changed when a voltage is applied to the control electrode; and a control unit controlling the voltage applied to the control electrode such that the electron beam is concentrated on the fluorescent surface when the electron beam is deflected.

In this case, the control unit controls the voltage such that if a distance between the cold cathode and a position at which the electron beam is radiated on the fluorescent surface is changed to be longer as the result that the electron beam is deflected, the longer the distance, the lower a potential above the cold cathode becomes.

Also in this case, the control unit controls the voltage such that if a distance between the cold cathode and a position at which the electron beam is radiated on the fluorescent surface is changed to be longer as the result that the electron beam is deflected, an expansion of the electron beam is suppressed.

Further in this case, the control unit controls the voltage such that if a distance between the cold cathode and a position at which the electron beam is radiated on the fluorescent surface is changed to be longer as the result that the electron beam is deflected, a focus point of the electron beam is positioned at a further point.

In this case, the control unit controls the voltage to be a lower value when a distance between the cold cathode and a position at which the electron beam is radiated on the fluorescent surface is changed to be longer as the result that the electron beam is deflected.

Also in this case, the control unit controls the voltage to be a value close to a voltage applied to a gate electrode of the cold cathode.

Further in this case, the control electrode is circular provided around the cold cathode.

In order to achieve yet still another aspect of the present invention, a display apparatus, includes: a plurality of cold cathodes including a first cold cathode and a second cold cathode; a deflecting unit deflecting in a deflecting direction a plurality of electron beams respectively emitted from the plurality of cold cathodes; first and second control electrodes provided for at least one of the plurality of cold cathodes; and a control unit controlling a first voltage applied to the first control electrode such that a first potential of the first cold cathode is different from a second potential of the second cold cathode, wherein the first potential is a potential difference between a first deflecting side in the deflecting direction and a first opposite side opposite to the first deflecting side above the first cold cathode, and the second potential is a potential difference between a second deflecting side in the deflecting direction and a second opposite side opposite to the second deflecting side above the second cold cathode, and controlling a second voltage applied to the second control electrode such that if a distance between one of the plurality of cold cathodes and positions at which the plurality of electron beams are radiated on the fluorescent surface is changed to be longer as the result that the plurality of electron beams are deflected, the longer the distance, the lower the second voltage becomes.

In this case, the fluorescent surface is a flat-type.

A first invention of a method of driving an electric field emission type cold cathode element is as follows.

A method of driving an electric field emission type cold cathode element includes: providing an emitter section; mounting a gate electrode (1*b*) in the vicinity of the emitter section; providing an electric field emission type cold cathode (1) for emitting an electron from the emitter section to the gate electrode (1*b*) by applying a positive voltage to the emitter section; arraying a plurality of cold cathodes (1) on a line; mounting at least one control electrode (2) in at least one of the plurality of cold cathodes (1); converging an electron beam emitted from the emitter section through an electron lens (4), and then deviating through a magnetic field, and further irradiating to a screen (5); and controlling the control electrode (2), wherein the step of controlling the control electrode (2) controls the control electrode (2) so that a first potential difference at a first cold cathode (1) among the plurality of cold cathodes (1) is different from a second potential difference at a second cold cathode (1) among the plurality of cold cathodes (1), and here the first potential difference implies a potential difference between a reverse deflection side and the deflection side immediately on the first cold cathode (1), and the second cold cathode (1) is located on the reverse deflection side from the first cold cathode (1), and the second potential difference implies a potential difference between the reverse deflection side and the deflection side immediately on the second cold cathode (1).

The step of providing the emitter section provides the emitter section in which a plurality of micro emitters (la) are mounted in a form of array.

The step of controlling the control electrode (2) controls the control electrode (2) so that the second potential difference is lower than the first potential difference.

The step of arraying the plurality of cold cathodes (1) on the line arrays three electric field emission type cold cathodes (1) in order to create the electric field emission type cold cathode element.

The step of mounting the control electrode (2) mounts the control electrodes (2) in forward and backward directions with respect to the array direction of the plurality of cold cathodes (1), for each of the plurality of cold cathodes (1).

A method of driving an electric field emission type cold cathode element includes: providing an emitter section; mounting a gate electrode (1*b*) in the vicinity of the emitter section; providing an electric field emission type cold cathode (1) for emitting an electron from the emitter section to the gate electrode (1*b*) by applying a positive voltage to the emitter section; mounting at least one control electrode (2) in the cold cathode (1); converging an electron beam emitted from the emitter section through an electron lens (4), and then deviating through a magnetic field, and further irradiating to a screen (5); and controlling the control electrode (2), wherein the step of controlling the control electrode (2) controls the control electrode (2) so that when the deflection of the electric beam caused by the magnetic field causes a beam irradiation position on the screen (5) to get away, a potential immediately on the cold cathode (1) becomes lower as the beam irradiation position gets away.

The step of controlling the control electrode (2) controls the control electrode (2) in accordance with a deflection angle when the electron beam is deflected by the magnetic field.

Moreover, the present invention provides a display apparatus characterized in that the above-mentioned driving method is used to radiate the electron bean to the screen and carry out a display on the screen. On the screen, a light is emitted by the irradiation of the electron beam.

BRIEF DESCRIPTION OF THE DRAWINGS

A more complete understanding of the teachings of the present invention may be acquired by referring to the accompanying figures, in which like reference numbers indicate like features and wherein.

DESCRIPTION OF THE PREFERRED EMBODIMENTS

Figure 1:
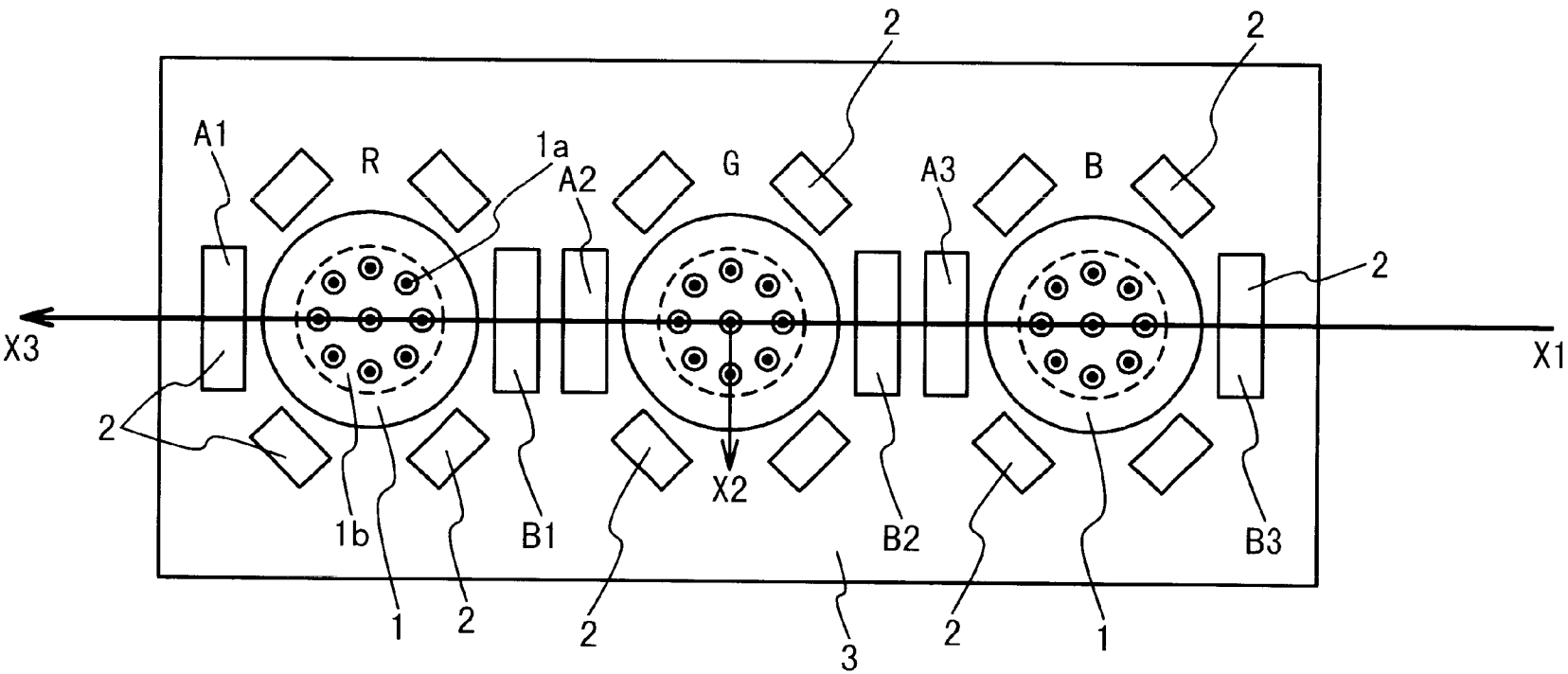
FIG. 1 is a plan view showing an electric field emission type cold cathode element in a first embodiment of the present invention.

Embodiments of the present invention will be described below with reference to the attached drawings. Particular voltage values and dimension values are indicated in the following explanation of the embodiments, especially in the explanation of actual examples. However, they are used only for the exemplification. Of course, the present invention is not limited to those actual values.

(First Embodiment)

This embodiment is an embodiment of the method of driving the electric field emission type cold cathode element in the first invention, and the display apparatus using this method.

The action of the first embodiment may be described, for example, as follows.

Electron beams which are emitted from plural, for example, three electric field emission type cold cathodes of the Braun tube and the like, are passed through an electron lens (including a main lens), and then the electron beams are concentrated into one point (strictly speaking, adjacently three areas belonging to a single pixel) on a screen and a diameter of a spot of the electron beams is made as small as possible, while the electron beams are deflected by a magnetic field.

In this case, in a conventional technique, in order to concentrate the three electron beams into the one point on the entire surface of the screen, the three electron beams are concentrated on the screen by changing the strengths of the magnetic fields applied to the beams emitted from the three cold cathodes each other, in such a way that a horizontal deflection magnetic field is set at a pincushion magnetic field and a vertical deflection magnetic field is set at a barrel magnetic field.

However, in this conventional technique, a difference between running routes of the electrons causes the strengths of the magnetic fields applied to the electrons to be different from each other. The fact results in a problem that the spot form of each of the beams is distorted.

By the way, the cold cathode is low in temperature, differently from the hot cathode. Thus, a control electrode can be mounted near the cold cathode. So, an electric field immediately over (above) the cold cathode can be changed by controlling a voltage applied to the control electrode. A potential of the electron emitted from the cold cathode is generally similar to a voltage of a gate electrode. So, an application of a voltage similar to the voltage of the gate electrode to the control electrode enables the electric field immediately over the cold cathode to be extremely easily changed, which enables the control of a moving direction of the electron.

Moreover, in the Braun tube an electrostatic lens (electron lens including a main lens) is used to concentrate or converge the electron beams emitted from the cathodes. In the electrostatic lens, the approximation of a paraxial trajectory is possible in a portion closer to the optical axis of the lens. However, as it gets away from the optical axis, a curve of the beam becomes larger because of spherical aberration. Beam incident on a portion away from the optical axis of the main lens is converged in the course of approaching the screen, due to the effect of the main lens. As the result of the convergence of this beam, a position of the beam incident on the screen is located on a side opposite to the side incident on the main lens with respect to the optical axis. The utilization of such principle enables the position of the beam spot to be very easily changed at a low voltage.

So, the first embodiment of the present invention is as shown below. Immediately over a specified cold cathode located in the deflection direction, a difference between a potential of the deflection side and a potential of the opposite side of the deflection side is set at a first potential. In this case, the difference means the subtraction of the potential of the opposite side from the potential of the deflection side, which is one of a positive or negative value and a value of zero. Immediately over another cold cathode located on the opposite side of the deflection side from the specified cold cathode, a difference between a potential of the deflection side and a potential of the opposite side of the deflection side is set at a second potential. The first potential is set to be different from the second potential. The first potential is made lower than the second potential. Thus, the deflection of the electron emitted from the cold cathode on the deflection side can be made larger, and the deflection of the electron emitted from the cold cathode on the opposite deflection side can be made smaller so that the beams emitted from the plurality of cold cathodes can be concentrated into one point. Accordingly, it is possible to attain the effect similar to that of the magnetic field provided by the deflection yoke of the conventional self-convergence.

In a case of a Braun tube having a wide screen surface, there may be a case that the beams emitted from the plurality of cold cathodes can not be sufficiently concentrated into the one point when an uniform magnetic field is used. Therefore in this case, the beams can be concentrated into the one point by concurrently using the deflection yoke of the conventional self-convergence in which the horizontal deflection magnetic field is the pincushion magnetic field and the vertical deflection magnetic field is the barrel magnetic field. Even in this case, the present invention can make the distribution of the strengths of the magnetic field smaller than that of the conventional self-convergence. Thus, it is possible to reduce the distortion in the beam resulting from the astigmatism and the coma caused by the magnetic field.

FIG. 1 shows an electric field emission type cold cathode element in a first embodiment of the present invention. FIG. 1 is a plan view showing a body of an electric field emission type cold cathode element 3. The electric field emission type cold cathode element 3 has three cold cathodes generating electron beams respectively corresponding to R, G and B image signals. The three cold cathodes 1 corresponding to R, G and B from a left side of FIG. 1 are arrayed in a direction (horizontal direction) of X1, X2 and X3.

A plurality of control electrodes 2 are mounted around each cold cathode 1. A plurality of micro emitters la in a form of array are collectively mounted at a center of each cold cathode 1 to form an emitter group. A gate electrode 1*b* is positioned around each emitter 1*a*. Such configuration is very similar to that disclosed in the above-mentioned Japanese Laid Open Patent Application (JP-A-Heisei, 9-115426).

Six control electrodes 2 are mounted around each of the three cold cathodes 1 corresponding to R, G and B. The respective control electrodes 2 are controlled independently of each other. Accordingly, it is possible to accurately carry out the vertical deflection as well as the horizontal deflection. Al and B1 denote those on both left and right sides in the horizontal direction among the control electrodes around the R cold cathode 1. A2 and B2 denote those n both left and right sides in the horizontal direction among the control electrodes 2 around the G cold cathode 1. And, A3 and B3 denote those on both left and right sides in the horizontal direction among the control electrodes 2 around the B cold cathode 1.

Figure 2:
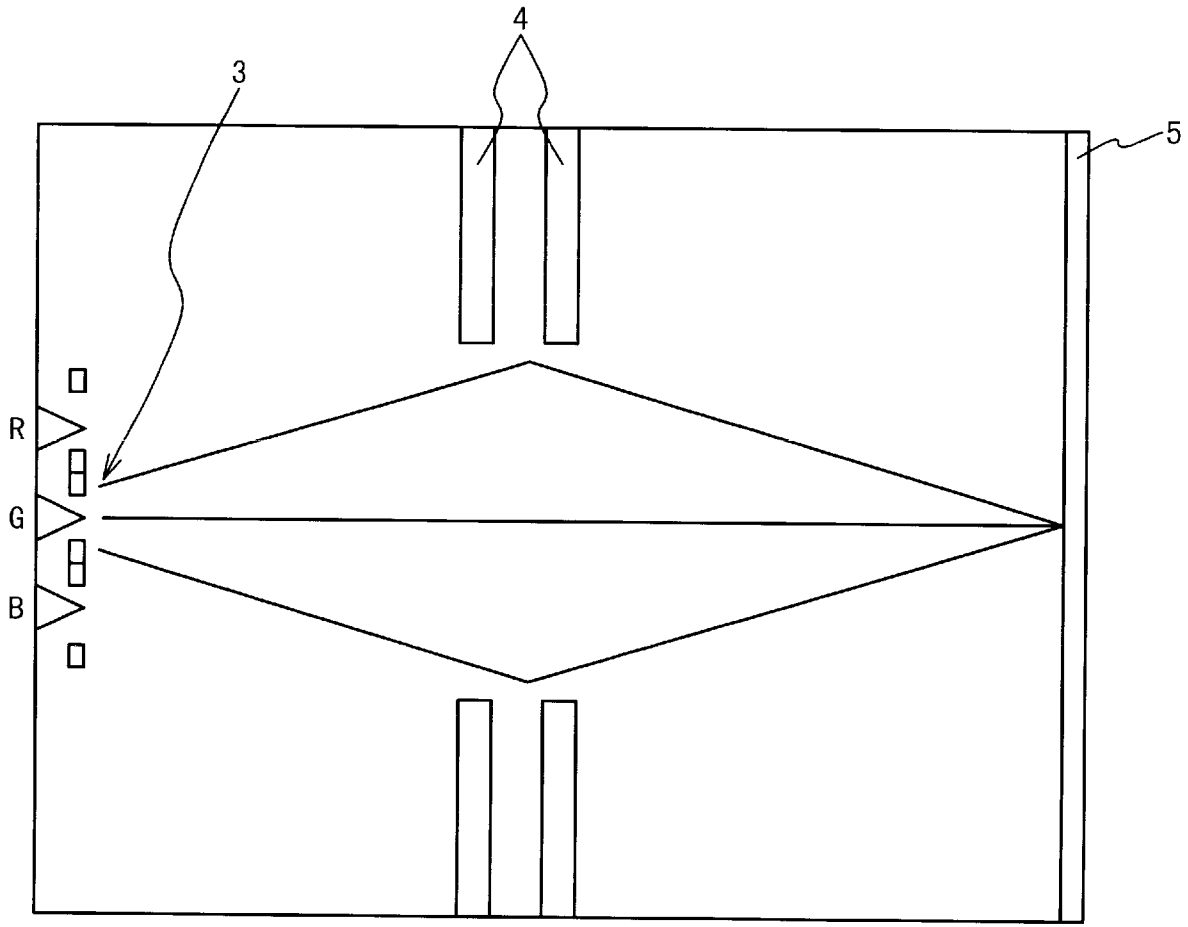
FIG. 2 is a diagrammatic configuration view showing a display apparatus using the cold cathode element in the first embodiment as an electron-generating source.

FIG. 2 is a diagrammatic configuration view showing a display apparatus using the above-mentioned cold cathode element 3 as an electron-generating source. Each of three electron beams emitted from the R, G and B cold cathodes 1 of the cold cathode element 3 is converged by an electron lens (including a main lens) 4 to be spot-radiated to a screen 5. Each electron beam is passed through a hole formed correspondingly to each electron beam in each electrode constituting the electron lens 4. Representatively, FIG. 2 diagrammatically shows only the electron beam emitted from the G cold cathode 1 and a hole formed in the electrode of the lens 4 corresponding to the electron beam emitted from the G cold cathode 1.

The screen 5 has, for example, a fluorescent surface, and each display pixel has R, G and B light emission fluorescent areas.

Figure 3:
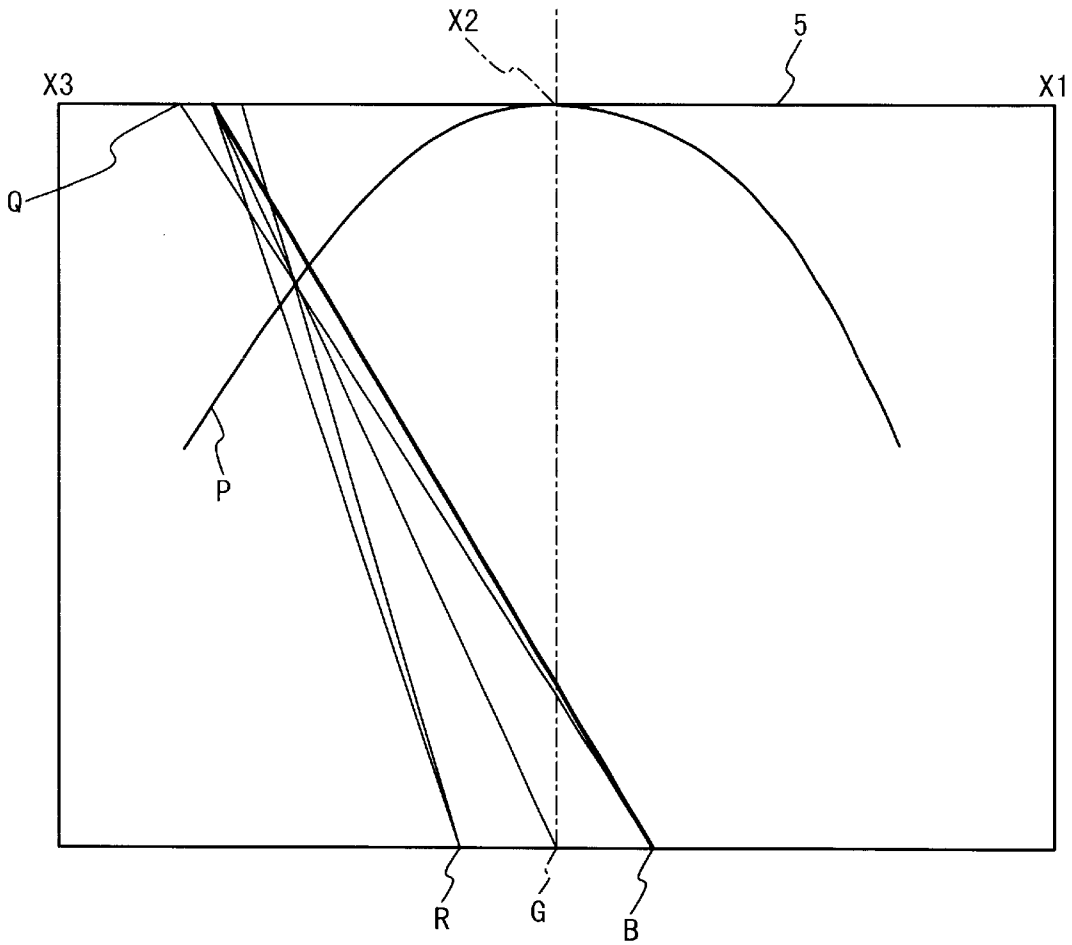
FIG. 3 is a view conceptually showing an electron orbit when electron beams emitted from the cold cathode approach a screen after they are passed through a main lens.

FIG. 3 is a view conceptually showing the electron orbit when the electron beams emitted from the R, G and B cold cathodes 1 approach the screen 5 after passing through the main lens. The electron beams are spot-scanned from X1 to X2 and X3 on the screen 5 by the horizontal deflection. The X2 is a position opposite to the center of the G cold cathode 1 of FIG. 1.

Figure 4A:
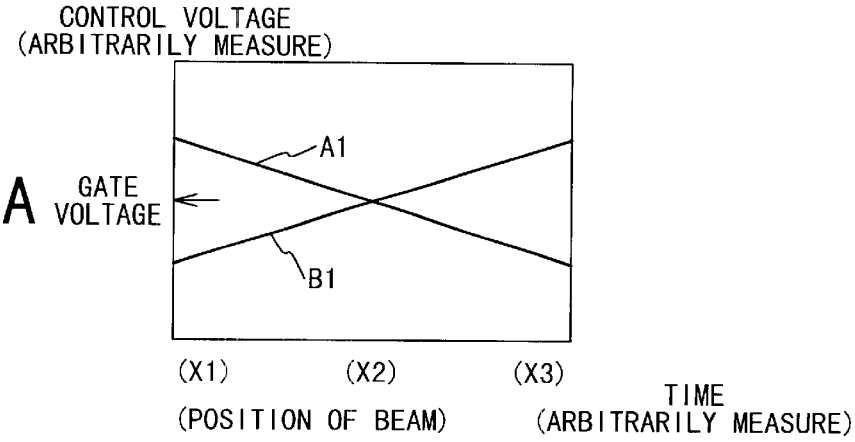
FIG. 4A is a view showing a temporal change of voltages applied to control electrodes of the R cold cathode together with a position of the beam spot, if the electron beam emitted from the R cold cathode is deflected from X1 to X3.
Figure 4B:
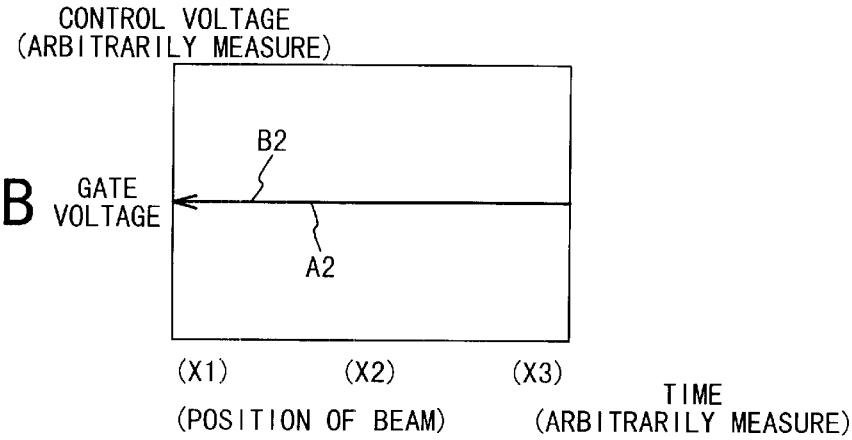
FIG. 4B is a view showing a temporal change of voltages applied to control electrodes of the G cold cathode together with a position of the beam spot, if the electron beam emitted from the G cold cathode is deflected from X1 to X3.
Figure 4C:
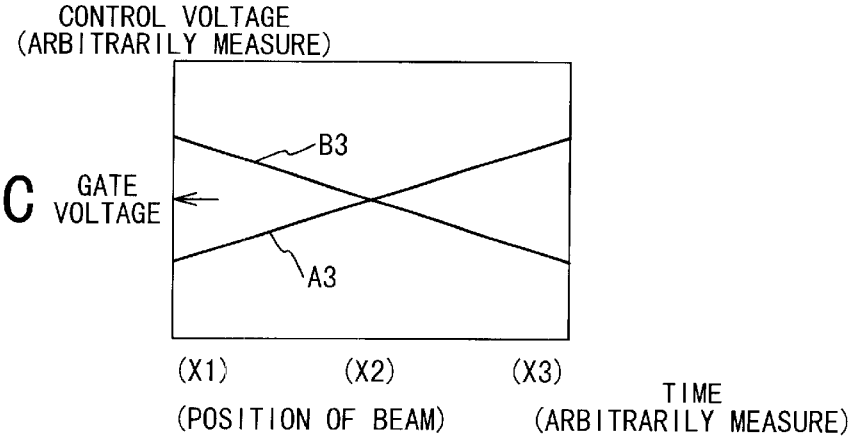
FIG. 4C is a view showing a temporal change of voltages applied to control electrodes of the B cold cathode together with a position of the beam spot, if the electron beam emitted from the B cold cathode is deflected from X1 to X3.

FIG. 4A is a view showing the temporal change of the voltages respectively applied to the control electrodes A1 and B1 of the R cold cathode 1, when the electron beam emitted from the R cold cathode 1 is deflected from the X1 to the X3 in the horizontal direction, as shown by an arrow of FIG. 1. FIG. 4B is a view showing the temporal change of the voltages respectively applied to the control electrodes A2 and B2 of the G cold cathode 1, when the electron beam emitted from the G cold cathode 1 is deflected from the X1 to the X3 in the horizontal direction, as shown by an arrow of FIG. 1. FIG. 4C is a view showing the temporal change of the voltages respectively applied to the control electrodes A3 and B3 of the B cold cathode 1, when the electron beam emitted from the B cold cathode 1 is deflected from the X1 to the X3 in the horizontal direction, as shown by an arrow of FIG. 1.

In the embodiment, such voltages as shown in FIGS. 4A, 4B and 4C are applied to correct or compensate the orbits of the electron beams. That is, as shown in FIG. 3, when the three electron beams are emitted from three guns of the R, G and B cold cathodes 1 and then the three electron beams are deflected near the X3, the three electron beams are concentrated into a position P (on this side from the screen 5), in a case of an uniform magnetic field. When horizontal deflection angles of the three electron beams are changed, the three electron beams are concentrated into a position separated by distance corresponding to the deflection angles on this side from the screen 5, as shown in FIG. 3.

So, the voltages applied to the control electrodes A1, B1 of the R cold cathode 1 are changed as shown in FIG. 4A, the voltages applied to the control electrodes A2, B2 of the G cold cathode 1 are maintained at the voltage of the gate electrode as shown in FIG. 4B, the voltages applied to the control electrodes A3, B3 of the B cold cathode 1 are changed as shown in FIG. 4C. When under the above mentioned condition as shown FIGS. 4A, 4B, and 4C, the three electron beams are deflected near the X3, the electron emitted from the R cold cathode 1 is passed through a portion close to the X1 in the corresponding electrode hole of the main lens so that the beam approaching the screen 5 is curved to the opposite direction (direction to the X3), and the electron emitted from the B cold cathode is passed through a portion close to the X3 in the corresponding electrode hole of the main lens so that the beam approaching the screen 5 is curved to the opposite direction (direction to the X1). Thus, the beams emitted from the three guns of the R, G and B cold cathodes 1 can be concentrated into a position Q of FIG. 3, namely, on the screen 5. In this embodiment, the voltages applied to the control electrodes A2, B2 of the G cold cathode 1 are not changed. However, this is not limited in a case of using a later-described second embodiment.

If the deflection angle is large, there may be a case that the beams emitted from the three guns can not be sufficiently concentrated into one point because of the application electrode and a power source. However, even in this case, they can be concentrated into the one point by concurrently using the deflection yoke having the magnetic distribution smaller than that of the deflection yoke of the conventional self-convergence. So, it is possible to attain a small spot form with a small deformation. At this time, the utilization of the present invention increases a degree of flexibility in the deflection yoke, and also makes the magnetic distribution smaller, which reduces the degradation of the size and the beam form caused by the magnetic distribution.

An actual example will be described below. First to third cold cathodes 1, each having a form of a circle with a diameter of 30 $\mu$m, are arrayed in a form of line. As shown in FIG. 1, the control electrodes A1, B1, and A2, B2, and A3, B3, each having a width of 200 $\mu$m, are arranged in the array direction of the first to third cold cathodes 1 for the first to third cold cathodes 1. The control electrodes A1, B1 oppose each other to sandwich the first cold cathode 1 between them. The control electrodes A2, B2 oppose each other to sandwich the second cold cathode 2 between them. The control electrodes A3, B3 oppose each other to sandwich the third cold cathode 1 between them. A gap between each of the control electrodes A1, B1 and the first cold cathode 1 is 10 $\mu$m. A gap between each of the control electrodes A2, B2 and the second cold cathode 1 is 10 $\mu$m. A gap between each of the control electrodes A3, B3 and the third cold cathode 1 is 10 $\mu$m.

An electron lens is provided with a G1 electrode, a G2 (acceleration) electrode and a G3 (convergence) electrode from this side to a rear portion. The electron lens is arranged above (over) the first to third cold cathodes 1. Three holes through which the three electron beams emitted from the first to third cold cathodes 1 are respectively passed are formed in each of the G1, G2 and G3 electrodes of the electron lens.

A diameter of the hole of the G1 electrode is set at 1.0 mm. A diameter of an inlet side of the hole of the G2 electrode is set at 1.0 mm. A diameter of an outlet side of the hole of the G2 electrode is set at 8.0 mm. A diameter of the hole of the G3 electrode is set at 8.0 mm. A distance between the cold cathodes 1 and the G1 electrode is set at 0.7 mm. A distance between the G1 electrode and the G2 electrode is set at 0.45 mm. A distance between the inlet side and the outlet side of the G2 electrode is set at 24 mm. A distance between the G2 electrode and the G3 electrode is set at 1.0 mm. 1000 V is applied to the G1 electrode. 4500 V is applied to the G2 electrode. 18 KV is applied to the G3 electrode. Then, the electron beams emitted from the three cold cathodes 1 are concentrated on the screen separated by 30 cm from the G3 electrode. The main lens is provided with the G2 electrode and the G3 electrode.

When the voltage of the gate electrode 1*b* of the each cold cathode 1 is set at 60 V and then the voltage of 60 V is applied to all the control electrodes 2, the electron beams emitted from the first to third cold cathodes 1 are concentrated on the screen if a magnetic field is not applied to the electron beams. As opposed to this, a deviation from each other of the three beam spots are measured on the screen when the magnetic field is applied to deflect the electron beams by about 10 degrees.

On the other hand, under the following condition, a deviation from each other of the three beam spots are not measured on the screen even when the magnetic field is applied to deflect the electron beams by about 10 degrees. That is to say, the voltage of the gate electrode 1*b* of the each cold cathode 1 is set at 60 V. A voltage of 60 V is initially applied to each of the control electrodes A1, B1, and A2, B2, and A3, B3 of the first to third cold cathodes 1. Next, the electron beams are deflected in the direction of the X3 of FIG. 1 by the application of the magnetic field, while the voltages of the control electrodes B1, A2, B2 and A3 are maintained at 60 V, and a voltage lower than 60 V is applied to the control electrode A1, and a voltage lower than 60 V is applied to the control electrode B3.

Immediately over the first (R) cold cathode 1 located in the deflection direction of the X3, a difference between a potential of the deflection side of the A1 and a potential of the side of the B1 opposite to the deflection side A1 is set at a first potential. In this case, the difference means the subtraction of the potential of the opposite side B1 from the potential of the deflection side A1, which is a negative value as shown FIG. 4A. Immediately over the third (B) cold cathode 1 located on the opposite side of the deflection side X3 from the first cold cathode 1, a difference between a potential of the deflection side of the A3 and a potential of the side of B3 opposite to the deflection side A3 is set at a second potential. The difference corresponding to the second potential means the subtraction of the potential of the opposite side B3 from the potential of the deflection side A3, which is a positive value as shown FIG. 4C. The first potential is set to be different from the second potential. The first potential is made lower than the second potential. Thus, the deflection of the electron emitted from the first cold cathode 1 on the deflection side X3 can be made larger, and the deflection of the electron emitted from the third cold cathode 1 on the opposite deflection side X1 can be made smaller so that the beams emitted from the plurality of cold cathodes 1 can be concentrated into one point.

(Second Embodiment)

A second embodiment of the present invention is a method of driving an electric field emission type cold cathode element, and a display apparatus using it.

At first, the action of the second embodiment is described.

The deflection of the electron beams causes a distance between the main lens and the screen to be changed, and thereby brings about the state that the electron beams go out of focus. In the conventional main lens, especially in a four-pole lens and the like, another electrode (focus electrode) is mounted to apply a voltage from external portion. The voltage is applied to the focus electrode such that the focus of the lens is dynamically adjusted in accordance with the degree of the deflection. In such a method, for example, in a case of a screen voltage of 25 KV, an average value of about 6 KV is applied to a dynamic adjustment electrode. The dynamic adjustment must be done at a maximum of about 1 KV although it depends on its apparatus.

On the contrary, according to the embodiment, the voltage applied to the control electrode near the emitter of the cold cathode is controlled such that the potential immediately over (above) the cold cathode is reduced. Thereby, the expansion of the electron beam is suppressed, and the passing position of the electron beam through the main lens becomes closer to the optical axis of the main lens, and the affection of the spherical aberration is reduced, and the focus point of the electron beam become a far side. Thus, when the distance from the emitter to the screen is increased in accordance with the increase of the deflection angle of the electron beam, the focus point is positioned in a far side such that the focus of the electron beam can be adjusted on the screen.

This is the dynamic focus adjustment function similar to the conventional technique. However, the voltage applied to the control electrode near the emitter is a value close to the gate voltage. Thus, the reliability is extremely improved over the conventional technique adjusting the voltage that is several KV and about 1 KV in synchronization with the deflection frequency. Hence, its effect is very large due to the simplification of a circuit and the drop of a consumption power.

The embodiment can be used with the conventional dynamic focus, if the focus can not be sufficiently adjusted on the screen because of the wide deflection angle. Even in this case, the width of the voltage variation in the voltage control necessary for the dynamic operation can be suppressed over the case in which the embodiment is not used. It is possible to drop the consumption power and also possible to simplify the power source and the circuit.

Figure 5:
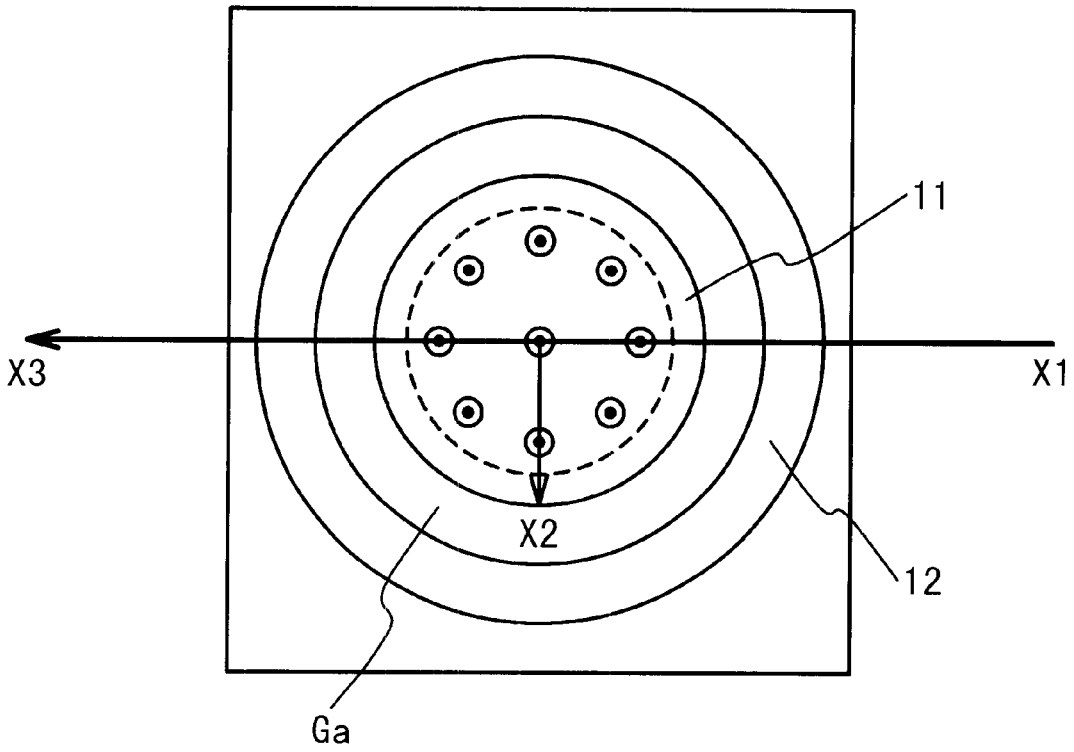
FIG. 5 is a plan view showing an electric field emission type cold cathode element in a second embodiment of the present invention.

FIG. 5 shows an electric field emission type cold cathode element in the second embodiment of the present invention. FIG. 5 is a plan view of the cold cathode element. A ring-shaped control electrode 12 is mounted around a gate electrode of a cold cathode 11 having the configuration similar to that of the first embodiment to control a potential immediately over (above) the cold cathode 11.

Figure 6A:
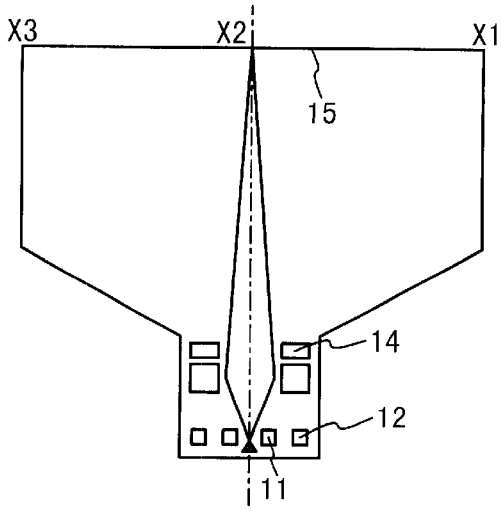
FIG. 6A is a view showing sections of a screen, and an electron lens including a main lens, and a route of a beam when an electron beam spot is scanned from X1 to X3 on a screen above a cold cathode.
Figure 6B:
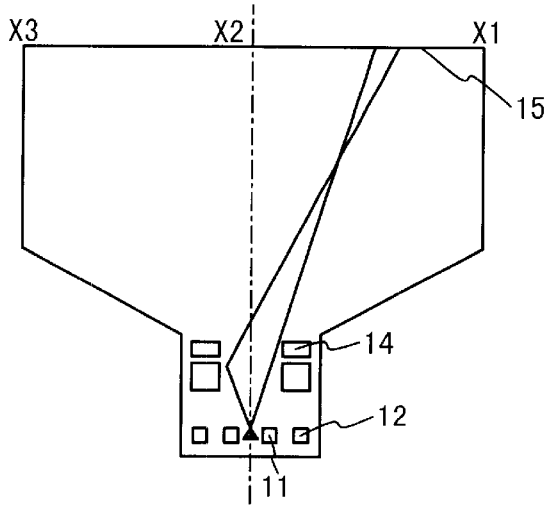
FIG. 6B is a view showing sections of a screen, and an electron lens including a main lens, and another route of a beam when an electron beam spot is scanned from X1 to X3 on a screen above a cold cathode.
Figure 6C:
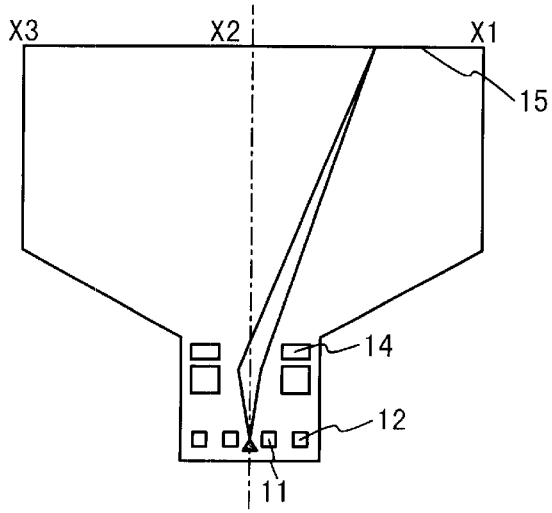
FIG. 6C is a view showing sections of a screen, and an electron lens including a main lens, and still another route of a beam when an electron beam spot is scanned from X1 to X3 on a screen above a cold cathode.

FIGS. 6A, 6B and 6C show sections of a screen 15, and an electron lens 14 including a main lens, and a route of an electron beam when the electron beam is deflected from X1 to X3 on the screen 15 above a cold cathode 11.

In FIG. 6A, if a predetermined voltage is applied to the control electrode 12, a diffusion beam emitted from the cold cathode 11 is converged by the electron lens 14 to generate a spot on the screen 15.

FIG. 6B shows a route of an electron beam when the electron beam is deflected by the application of a deflection magnetic field, under the condition that the voltage equal to the voltage applied to the control electrode 12 in the case of FIG. 6A is applied to the control electrode 12 of FIG. 6B. As shown in FIG. 6B, the electron beam is focused in front of the screen 15.

FIG. 6C shows a route of an electron beam when the voltage applied to the control electrode 12 is set to be lower than those of FIGS. 6A and 6B to suppress the expansion of the electron beam emitted from the cold cathode 11. In the case of FIG. 6C, since a thin (narrow) beam is passed through the electron lens 14, it does not receive the affection of the spherical aberration. Thus, the focus point can be set on the screen 15.

Figure 7:
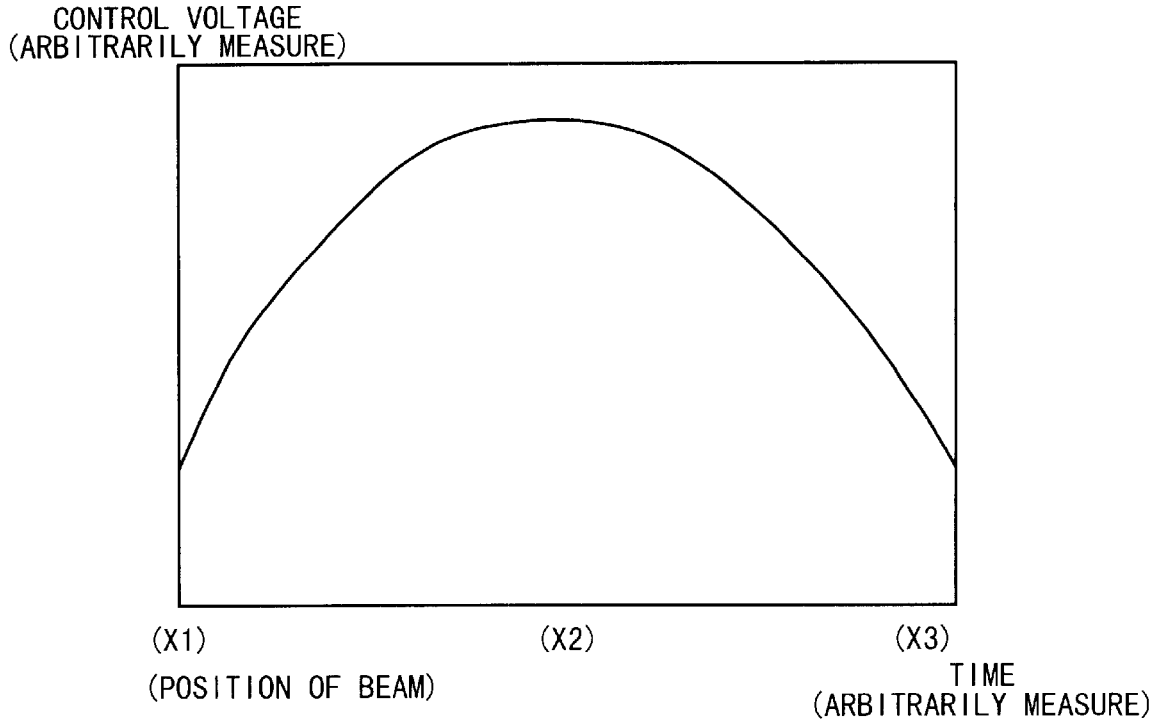
FIG. 7 is a view showing a temporal elapse of a voltage applied to a control electrode in order that an electron beam is focused on a screen if the electron beam is deflected from X1 to X2 and X3, together with a position of a beam spot.

FIG. 7 shows the temporal elapse of a voltage applied to a control electrode in order that an electron beam is focused on a screen if it is deflected from X1 to X2 and X3, together with a position of a beam spot. X1, X2 and X3 of FIG. 7 correspond to X1, X2 and X3 of FIG. 6, respectively. When the electron beam is passed through the X2, the voltage applied to the control electrode 12 is made higher. As the result of applying the higher voltage to the control electrode 12, the electron beam is expanded, the electron beam in the electron lens 14 is made larger, and the electron beam is excellently converged at a position close to the screen 15. As the electron beam approaches the X3, the voltage applied to the control electrode 12 is dropped such that the electron beam is passed through a position closer to a center of the electron lens 14. Hence, the focus point is positioned at a far side, and the electron beam is converged at a thin spot diameter on the screen 15 even in the case of the deflection of the electron beam.

If the deflection angle is wide, there may be a case that a sufficiently thin beam diameter can not be obtained even if the embodiment is used. However, in this case, a voltage lower than that of the conventional technique is applied to a focus electrode (as above-mentioned) such that the dynamic focus is performed to achieve a focus on the screen 15. Moreover, the modulation voltage can be dropped by using the embodiment with this dynamic focus. Thus, it is possible to drop the consumption power and also possible to improve the reliability of a drive circuit.

In a Braun tube in which a screen size is small and the dynamic focus is not used, a beam diameter is changed by a large amount, depending on a location of the screen. However, if the embodiment is applied to this Braun tube, the beam diameter is changed by a small amount on the entire surface of the screen, which accordingly makes the focusing excellent.

An actual example will be described below. A cold cathode 11 has a form of a circle with a diameter of 30 $\mu$m. A control electrode 12 having a width of 200 $\mu$m is mounted around the cold cathode 11. A gap Ga of 10 $\mu$m is formed between the cold cathode 11 and the control electrode 12. An electron lens 14 is provided with a G1 electrode, a G2 (acceleration) electrode and a G3 (convergence) electrode from this side to a rear portion. The electron lens 14 is mounted above (over) the cold cathodes 11. One hole through which the electron beam emitted from the cold cathodes 11 is passed is formed in each of the G1, G2 and G3 electrodes of the electron lens 14.

A diameter of the hole of the G1 electrode is set at 1.0 mm. A diameter of an inlet side of the hole of the G2 electrode is set at 1.0 mm. A diameter of an outlet side of the hole of the G2 electrode is set at 8.0 mm. A diameter of the hole of the G3 electrode is set at 8.0 mm. A distance between the cold cathode 11 and the G1 electrode is set at 0.7 mm. A distance between the G1 electrode and the G2 electrode is set at 0.45 mm. A distance between the inlet side and the outlet side of the G2 electrode is set at 24 mm. A distance between the G2 electrode and the G3 electrode is set at 1.0 mm. 1000 V is applied to the G1 electrode. 4500 V is applied to the G2 electrode. 18 KV is applied to the G3 electrode. Then, the electron beam emitted from the cold cathode 11 is concentrated on the screen 15 separated by 30 cm from the G3 electrode. The main lens is provided with the G2 electrode and the G3 electrode.

When a voltage applied to the gate electrode of the cold cathode 11 is set at 60 V and then the voltage of 60 V is applied to the control electrode 12, the electron beam emitted from the cold cathode 11 is concentrated on the screen 15 if a magnetic field is not applied to the electron beam. However, when the magnetic field is applied to deflect the electron beam by about 10 degrees, it is measured that a diameter of a beam spot of the electron beam is made larger on the screen 15 and the focus is gone out of a point on the screen 15. On the other hand, when the electron beam is deflected by the application of the magnetic field, a voltage applied to the gate electrode of the cold cathode 11 is set at 60 V, and a voltage lower than 60 V is applied to the control electrode 12, it is measured that the diameter of the beam spot is not made larger on the screen 15 and the focus is located on the screen, even in the case of the deflection of the 10 degrees.

In this embodiment, the explanation has been done with regard to the one cold cathode. However, it can be similarly applied to a case in which a plurality of cold cathodes are used such as a color Braun tube.

Also, it is possible to jointly use the technique for concentrating the plurality of electron beams on the screen at the time of the deflection such as the first embodiment and the technique for converging the electron beam on the screen at the time of the deflection such as the second embodiment.

Also, in the above-mentioned explanations, only the deflection in the one direction is described. However, the case of the deflection in both the horizontal direction and the vertical directions can be similarly done. Especially in the case of the concentration of the electron beams emitted from the plurality of cold cathodes such as the first embodiment, the combination of the control of the control electrodes A1 to B3 for the horizontal deflection as mentioned above and the control of the control electrodes except A1 to B3 to the vertical deflection enables the electron beams emitted from the three guns of the in-line to be concentrated into the one point on the screen or to be focused on the screen with regard to the horizontal and vertical directions.

Each of the first and second embodiment can be applied to a flat-display type Braun tube.

As mentioned above, according to the present invention, even if the electron beams are passed through the deflection magnetic field having no strength distribution or having a strength distribution smaller than that of the conventional technique, it is possible to cancel out the distortion of the electron beam caused by the astigmatism or the coma resulting from the magnetic distribution of the beam or possible to reduce the distortion.

The adjustment of the voltage applied to the control electrode near the cold cathode enables the dynamic focus adjustment function similar to the conventional technique, even in a case that the distance to a beam radiated position of the screen is changed by the deflection of the electron beam. Moreover, the voltage applied to the control electrode near the cold cathode is a value close to the gate voltage. Thus, the effect is large due to the improvement of the reliability as compared with the conventional technique for adjusting the voltage that is about 1 KV in synchronization with the deflection frequency, and the simplification of the circuit, and the drop of the consumption power.

If the focus can not be sufficiently adjusted on the screen because the deflection angle is wide, it is possible to jointly use the present invention with the dynamic focus and the deflection yoke for the conventional self-convergence, to thereby enable the operation of the cold cathode in the magnetic distribution smaller than the case of not using the present invention. Moreover, it is possible to suppress the distortion of the electron beam caused by the magnetic field and also possible to reduce the width of the voltage in the voltage control necessary for the dynamic operation. Therefore, it is possible to achieve the drop of the consumption power and the simplification of the power source and the circuit.

What is claimed is:

1. A method of driving a cold cathode element, comprising:

(a) providing three cold cathodes;

(b) deflecting three electron beams respectively emitted from said three cold cathodes;

(c) providing a different control electrode for each of said three cold cathodes, wherein electric fields above said control electrodes change when voltages are applied to said control electrodes; and (d) controlling the voltages applied to said control electrodes such that all said three electron beams are directed to one location on a fluorescent surface.

2. A method of driving a cold cathode element according to claim 1, wherein said (d) step includes controlling said voltages to values close to voltages applied to respective gate electrodes of said three cold cathodes.

3. A method of driving a cold cathode element according to claim 1, wherein said (d) step includes controlling said voltages such that if a distance between a one of said three cold cathodes and a position at which the respective electron beam is radiated on said fluorescent surface increases as the result of said (b) step, the lower a potential above said one cold cathode becomes.

4. A method of driving a cold cathode element according to claim 1, wherein said (d) step includes controlling said voltages such that if a distance between a one of said cold cathodes and a position at which the respective said electron beam is radiated on said fluorescent surface increases as the result of said (b) step, an expansion of the respective electron beam is suppressed.

5. A method of driving a cold cathode element according to claim 1, wherein said (d) step includes controlling said voltages such that if a distance between a one of said cold cathodes and a position at which the respective said electron beam is radiated on said fluorescent surface increases as the result of said (b) step, a focus point of the respective electron beam is positioned at a further point.

6. A method of driving a cold cathode element according to claim 1, wherein said (d) step includes decreasing a respective one of said voltages when a distance between the respective one of said three cold cathodes and a position at which the respective said electron beam is radiated on said fluorescent surface increases as the result of said (b) step.

7. A method of driving a cold cathode element according to claim 1, wherein said (c) step includes providing circular ones of the control electrodes around each of said three cold cathodes.

8. A method of driving a cold cathode element, comprising:

(e) providing a plurality of cold cathodes including a first cold cathode and a second cold cathode;

(f) deflecting in a deflecting direction a plurality of electron beams respectively emitted from said plurality of cold cathodes;

(g) providing at least one control electrode for at least one of said plurality of cold cathodes; and (h) controlling a voltage applied to said control electrode such that a first potential of said first cold cathode is different from a second potential of said second cold cathode, wherein said first potential is a potential difference between a first deflecting side in said deflecting direction and a first opposite side opposite to said first deflecting side above said first cold cathode, and said second potential is a potential difference between a second deflecting side in said deflecting direction and a second opposite side opposite to said second deflecting side above said second cold cathode.

9. A method of driving a cold cathode element according to claim 8, wherein said (g) step includes providing said control electrode such that an electric field above said control electrode is changed when a voltage is applied to said control electrodes.

10. A method of driving a cold cathode element according to claim 8, wherein said (e) step includes providing said plurality of cold cathode such that said first cold cathode is provided nearer in said deflecting direction than said second cold cathode, and wherein said (h) step includes controlling said voltage such that said first potential is lower than said second potential.

11. A method of driving a cold cathode element according to claim 8, wherein said (g) step includes providing a couple of said control electrodes on a deflecting side in said deflecting direction and an opposite side opposite to said deflecting side of each of said plurality of cold cathodes.

12. A method of driving a cold cathode element according to claim 11, wherein said (g) step includes providing said couple of control electrodes such that said voltage applied to one of said couple of control electrodes is controlled independently of said voltage applied to the other of said couple of control electrodes.

13. A method of driving a cold cathode element according to claim 8, wherein said (g) step includes providing a plurality of said control electrodes around each of said plurality of cold cathodes.

14. A method of driving a cold cathode element according to claim 8, wherein said (g) step includes providing a plurality of said control electrode respectively corresponding to said first deflecting an opposite sides and said second deflecting and opposite sides.

15. A method of driving a cold cathode element according to claim 14, wherein said (e) step includes providing said plurality of cold cathode such that said first cold cathode is provided nearer in said deflecting direction than said second cold cathode, and wherein said (e) step includes providing said plurality of cold cathodes such that each of said plurality of cold cathodes includes a gate electrode, plurality of voltages applied to a plurality of said gate electrode corresponding to said plurality of cold cathodes being a same with respect to each other, and wherein said (h) step includes controlling a first deflecting voltage applied to said control electrode corresponding to said first deflecting side to be lower than a first gate voltage applied to said gate electrode of said first cold cathode said control electrode corresponding to said first opposite side to be higher than said first gate voltage and controlling a second deflecting voltage applied to said control electrode corresponding to said second deflecting side to be higher than a second gate voltage applied to said gate electrode of said second cold cathode, and controlling a second opposite voltage applied to said control electrode corresponding to said second opposite side to be lower than said second gate voltage.

16. A method of driving a cold cathode element, comprising:

(aa) providing three cold cathodes in an in-line arrangement, wherein said three cold cathodes correspond to three primary colors of a red (R), a green (G) and a blue (B), respectively and each of said three cold cathodes includes a gate electrode;

(ab) applying a first gate voltage to said gate electrode of said cold cathode, as a R cold cathode, corresponding to said R;

(ac) applying a second gate voltage to said gate electrode of said cold cathode, as a G cold cathode, corresponding to said G;

(ad) applying a third gate voltage to said gate electrode of said cold cathode, as a B cold cathode, corresponding to said B;

(ae) deflecting three electron beams respectively emitted from said three cold cathodes in a deflecting direction along said arrangement proceeding from said B cold cathode to said R cold cathode;

(af) providing a first deflecting control electrode in said deflecting direction of said R cold cathode and a first opposite control electrode in a direction opposite to said deflecting direction of said R cold cathode;

(ag) providing a second deflecting control electrode in said deflecting direction of said G cold cathode and a second opposite control electrode in said opposite direction of said G cold cathode;

(ah) providing a third deflecting control electrode in said deflecting direction of said B cold cathode and a third opposite control electrode in said opposite direction of said B cold cathode; and (ai) controlling a first deflecting voltage applied to said first deflecting control electrode to be lower than said first gate voltage and controlling a first opposite voltage applied to said first opposite control electrode to be higher than said first gate voltage and controlling a second voltage applied to each of said second deflecting and opposite control electrodes equal to said second gate voltage and controlling a third deflecting voltage applied to said third deflecting control electrode to be higher than said third gate voltage, and controlling a third opposite voltage applied to said third opposite control electrode to be lower than said third gate voltage, and wherein when a voltage is applied to each of said first deflecting and opposite control electrodes and said second deflecting and opposite control electrodes, and said third deflecting and opposite control electrodes, an electric field above said each voltage-applied control electrode is changed, respectively.

17. A method of driving a cold cathode element, comprising:

(ca) providing a plurality of cold cathodes including a first cold cathode and a second cold cathode;

(cb) deflecting in a deflecting direction a plurality of electron beams respectively emitted from said plurality of cold cathodes;

(cc) providing first and second control electrodes for at least one of said plurality of cold cathodes;

(cd) controlling a first voltage applied to said first control electrode such that a first potential of said first cold cathode is different from a second potential of said second cold cathode, wherein said first potential is a potential difference between a first deflecting side in said deflecting direction and a first opposite side opposite to said first deflecting side above said first cold cathode, and said second potential is a potential difference between a second deflecting side in said deflecting direction and a second opposite side opposite to said second deflecting side above said second cold cathode; and (ce) controlling a second voltage applied to said second control electrode such that if a distance between one of said plurality of cold cathodes and positions at which said plurality of electron beams are radiated on said fluorescent surface is changed to be longer as the result of said (cb) step, the longer said distance, the lower said second voltage becomes.

18. A display apparatus, comprising:

three cold cathodes from which three electron beams are emitted respectively;

a fluorescent surface on which said three electron beams are radiated;

a different control electrode for each of said three cold cathodes, wherein electric fields above said control electrodes change when voltages are applied to said control electrodes; and a control unit controlling said voltages applied to said control electrodes such that when said three electron beams are deflected, all of said three electron beams are directed to one location on said fluorescent surface.

19. A display apparatus according to claim 18, wherein said control unit controls said voltages to values close to voltages applied to respective gate electrodes of said three cold cathodes.

20. A display apparatus according to claim 18, wherein said control unit controls said voltages such that if a distance between a respective one of said three cold cathodes and a position at which the respective said electron beam is radiated on said fluorescent surface increases as the result that said respective electron beam is deflected, the lower a potential above said respective cold cathode becomes.

21. A display apparatus according to claim 18, wherein said control unit controls said voltages such that if a distance between a respective one of said three cold cathodes and a position at which the respective said electron beam is radiated on said fluorescent surface increases as the result that said respective electron beam is deflected, an expansion of said respective electron beam is suppressed.

22. A display apparatus according to claim 18, wherein said control unit controls said voltages such that if a distance between a respective one of said three cold cathodes and a position at which the respective said electron beam is radiated on said fluorescent surface increases as the result that said respective electron beam is deflected, a focus point of said respective electron beam is positioned at a further point.

23. A display apparatus according to claim 18, wherein said control unit controls said voltages to be a lower value when a distance between a respective one of said three cold cathodes and a position at which the respective said electron beam is radiated on said fluorescent surface increases as the result that said respective electron beam is deflated.

24. A display apparatus according to claim 18, wherein each said control electrode is circular and provided around a respective one of said three cold cathodes.

25. A display apparatus according to claim 18, wherein said fluorescent surface is a flat-type.

26. A display apparatus, comprising:

a plurality of cold cathodes from which a plurality of electron beams are emitted respectively, wherein said plurality of cold cathodes include a first cold cathode and a second cold cathode;

a deflecting unit deflecting in a deflecting direction said plurality of electron beams;

a control electrode section for at least one of said plurality of cold cathodes; and a control unit controlling a voltage applied of said control electrode section such that a first potential of said first cold cathode is different from a second potential of said second cold cathode, wherein said first potential is a potential difference between a first deflecting side in said deflecting direction and a first opposite side opposite to said first deflecting side above said first cold cathode, and said second potential is a potential difference between a second deflecting side in said deflecting direction and a second opposite side opposite to said second deflecting side above said second cold cathode.

27. A display apparatus according to claim 26, wherein an electric field above said control electrode section is changed when a voltage is applied to said control electrode section.

28. A display apparatus according to claim 26, wherein said first cold cathode is provided nearer in said deflecting direction than said second cold cathode, and wherein said control unit controls said voltage such that said first potential is lower than said second potential.

29. A display apparatus according to claim 26, wherein said control electrode section includes a plurality of control electrodes respectively provided on a deflecting side in said deflecting direction and an opposite side opposite to said deflecting side of each of said plurality of cold cathodes.

30. A display apparatus according to claim 29, wherein a voltage applied to one of a couple of control electrodes corresponding to each of said plurality of cold cathodes of said plurality of control electrodes is controlled by said control unit, independently of a voltage applied to the other of said couple of control electrodes.

31. A display apparatus according to claim 26, wherein a plurality of control electrodes are provided, as said control electrode section, around each of said plurality of cold cathodes.

32. A display apparatus according to claim 31, wherein said plurality of control electrodes are provided respectively corresponding to said first deflecting and opposite sides and said second deflecting and opposite sides.

33. A method of driving a cold cathode element according to claim 32, wherein said first cold cathode is provided nearer in said deflecting direction than said second cold cathode, and wherein each of said plurality of cold cathodes includes a gate electrode, a plurality of voltages applied to a plurality of said gate electrode corresponding to said plurality of cold cathodes being a same with respect to each other, and wherein said control unit controls a first deflecting voltage applied to said control electrode corresponding to said first deflecting side to be lower than a first gate voltage applied to said gate electrode of said first cold cathode and controls a first opposite voltage applied to said control electrode corresponding to said first opposite side to be higher than said first gate voltage and controls a second deflecting voltage applied to said control electrode corresponding to said second deflecting side to be higher than a second gate voltage applied to said gate electrode of said second cold cathode, and controls a second opposite voltage applied to said control electrode corresponding to said second opposite side to be lower than said second gate voltage.

34. A display apparatus, comprising:

three cold cathodes in an in-line arrangement, wherein said three cold cathodes correspond to three primary colors of a red (R), a green (G) and a blue (B), respectively and each of said three cold cathodes includes a gate electrode;

a gate voltage applying unit applying a first gate voltage to said gate electrode of said cold cathode, as a R cold cathode, corresponding to said R, and applying a second gate voltage to said gate electrode of said cold cathode, as a G cold cathode, corresponding to said G; , and applying a third gate voltage to said gate electrode of said cold cathode, as a B cold cathode, corresponding to said B;

a deflecting unit deflecting three electron beams respectively emitted from said three cold cathodes in a deflecting direction along said arrangement proceeding from said B cold cathode to said R cold cathode;

a first deflecting control electrode in said deflecting direction of said R cold cathode;

a first opposite control electrode in a direction opposite to said deflecting direction of said R cold cathode;

a second deflecting control electrode in said deflecting direction of said G cold cathode;

a second opposite control electrode in said opposite direction of said G cold cathode;

a third deflecting control electrode in said deflecting direction of said B cold cathode;

a third opposite control electrode in said opposite direction of said B cold cathode; and a control unit controlling a first deflecting voltage applied to said first deflecting control electrode to be lower than said first gate voltage and controlling a first opposite voltage applied to said first opposite control electrode to be higher than said first gate voltage and controlling a second voltage applied to each of said second deflecting and opposite control electrodes equal to said second gate voltage and controlling a third deflecting voltage applied to said third deflecting control electrode to be higher than said third gate voltage, and controlling a third opposite voltage applied to said third opposite control electrode to be lower than said third gate voltage, and wherein when a voltage is applied to each of said first deflecting and opposite control electrodes and said second deflecting and opposite control electrodes, and said third deflecting and opposite control electrodes, an electric field above said each voltage-applied control electrode is changed, respectively.

35. A display apparatus, comprising:

a plurality of cold cathodes including a first cold cathode and a second cold cathode;

a deflecting unit deflecting in a deflecting direction a plurality of electron beams respectively emitted from said plurality of cold cathodes;

first and second control electrodes provided for at least one of said plurality of cold cathodes; and a control unit controlling a first voltage applied to said first control electrode such that a first potential of said first cold cathode is different from a second potential of said second cold cathode, wherein said first potential is a potential difference between a first deflecting side in said deflecting direction and a first opposite side opposite to said first deflecting side above said first cold cathode, and said second potential is a potential difference between a second deflecting side in said deflecting direction and a second opposite side opposite to said second deflecting side above said second cold cathode, and controlling a second voltage applied to said second control electrode such that if a distance between one of said plurality of cold cathodes and positions at which said plurality of electron beams are radiated on said fluorescent surface is changed to be longer as the result that said plurality of electron beams are deflected, the longer said distance, the lower said second voltage becomes.

* * * * *